US007815267B1

(12) United States Patent
Frousiakis

(10) Patent No.: US 7,815,267 B1
(45) Date of Patent: Oct. 19, 2010

(54) DRAWER SLIDE CLOSURE APPARATUS

(76) Inventor: Gus Frousiakis, 5332 Production Dr., Huntington Beach, CA (US) 92649

( * ) Notice: Subject to any disclaimer, the term of this patent is extended or adjusted under 35 U.S.C. 154(b) by 0 days.

(21) Appl. No.: 11/827,351

(22) Filed: Jul. 10, 2007

Related U.S. Application Data

(63) Continuation-in-part of application No. 11/521,800, filed on Sep. 15, 2006, now abandoned.

(51) Int. Cl.
*A47B 88/00* (2006.01)

(52) U.S. Cl. ..... 312/333; 312/319.1

(58) Field of Classification Search ..... 312/333, 312/334.44, 334.46, 334.47, 319.1, 334.7, 312/334.1, 334.8; 384/20–22
See application file for complete search history.

(56) References Cited

U.S. PATENT DOCUMENTS

| | | | | |
|---|---|---|---|---|
| 4,679,950 | A * | 7/1987 | Delmege et al. | 384/18 |
| 5,207,781 | A | 5/1993 | Rock | |
| 6,015,199 | A | 1/2000 | Netzer | |
| 6,848,759 | B2 * | 2/2005 | Doornbos et al. | 312/319.1 |
| 6,997,528 | B2 * | 2/2006 | Yang | 312/333 |
| 7,244,005 | B1 * | 7/2007 | Lu | 312/333 |
| 7,374,261 | B1 * | 5/2008 | Wang | 312/333 |
| 2003/0127957 | A1 * | 7/2003 | Lin | 312/333 |
| 2004/0144604 | A1 * | 7/2004 | Doornbos et al. | 188/290 |
| 2007/0001562 | A1 * | 1/2007 | Park | 312/333 |
| 2007/0182292 | A1 * | 8/2007 | Huang | 312/221 |
| 2008/0100190 | A1 * | 5/2008 | Yang et al. | 312/333 |
| 2008/0169741 | A1 * | 7/2008 | Jurja | 312/319.1 |
| 2008/0211366 | A1 * | 9/2008 | Brock et al. | 312/333 |
| 2008/0231156 | A1 * | 9/2008 | Hoshide et al. | 312/334.46 |
| 2009/0033187 | A1 * | 2/2009 | Chung | 312/319.1 |
| 2009/0115300 | A1 * | 5/2009 | Chen et al. | 312/334.1 |
| 2009/0189499 | A1 * | 7/2009 | Yang | 312/334.44 |

FOREIGN PATENT DOCUMENTS

| | | |
|---|---|---|
| DE | 20121255 U1 | 6/2002 |
| EP | 0391221 B1 | 3/1990 |
| EP | 0868866 B1 | 3/1998 |

* cited by examiner

*Primary Examiner*—Janet M Wilkens
(74) *Attorney, Agent, or Firm*—Dennis W. Beech

(57) ABSTRACT

An insert element for a drawer slide to assist in a drawer closure. A support member of generally rectangular form may be sized for positioning in a drawer slide element. A slide member may be slidably mounted on slide pins that may be attached at each end to a slide pin flange at a back end and an engagement end of the support member. A spring may be disposed on each of the slide pins intermediate the engagement end and the slide member. A shaft may be disposed at a first end in a roller slot formed longitudinally in a base of the support member and the roller slot may have a lock slot. A second end of the shaft may be disposed in a slide roller slot formed laterally in the slide member and a shaft retainer may be disposed between the support member and the slide member.

7 Claims, 7 Drawing Sheets

DRAWER SLIDE CLOSURE APPARATUS

This is a continuation-in-part application of U.S. patent application Ser. No. 11/521,800 filed on Sep. 15, 2006 now abandoned.

BACKGROUND OF THE INVENTION

This invention relates to apparatus for drawer slide devices that may support a drawer in furniture, a cabinet or other structure for opening and closing the drawer. The new apparatus may be positioned in a drawer slide element to assist in closing the drawer with springs and a catch mechanism.

Drawer slide devices for supporting a drawer in a cabinet or other structure may be known. Also, spring devices, bumpers and the like may be known to be installed to provide a bumper or cushion device to inhibit slamming of a drawer. The springs may also cause an initial force to partially open a drawer when a drawer catch is released. Mechanisms to add a drawer closure assisting force may not be known. Closure apparatus for compartment closure may be known, for example, the trunk of an automobile may have a catch and a motor to finally close the trunk lid. However, this is not a drawer closure mechanism.

SUMMARY OF THE INVENTION

The present invention is directed to apparatus to assist in a drawer slide closure. A support member of generally rectangular form may be sized for disposing in a first drawer slide element. A slide member may be slidably disposed on a pair of slide pins that may be attached at each end to a slide pin flange at a back end and an engagement end of the support member. A spring may be disposed on each of the slide pins intermediate the engagement end and the slide member. A shaft may be disposed at a first end in a roller slot formed longitudinally in a base of the support member and the roller slot may have a lock slot. A second end of the shaft may be disposed in a slide roller slot formed laterally in the slide member and a shaft retainer may be disposed between the support member and the slide member. A second drawer slide element may have a slide element slot disposed to receive a portion of the second end of the shaft.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
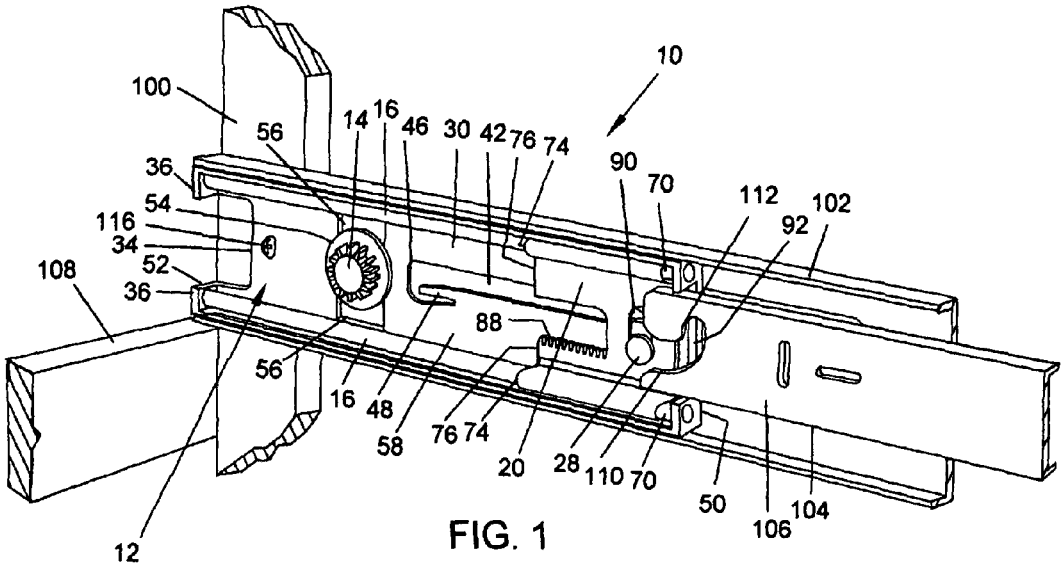
FIG. 1 illustrates a perspective view of an apparatus in a partial view of a drawer slide element and cabinet according to an embodiment of the invention.
Figure 2:
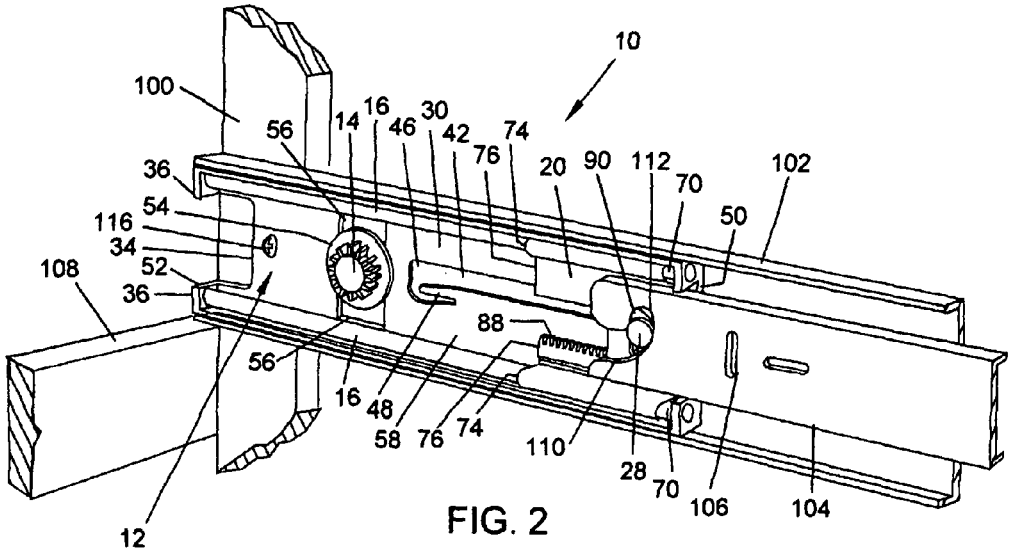
FIG. 2 illustrates a perspective view of an apparatus in a partial view of a drawer slide element and cabinet according to an embodiment of the invention.
Figure 3:
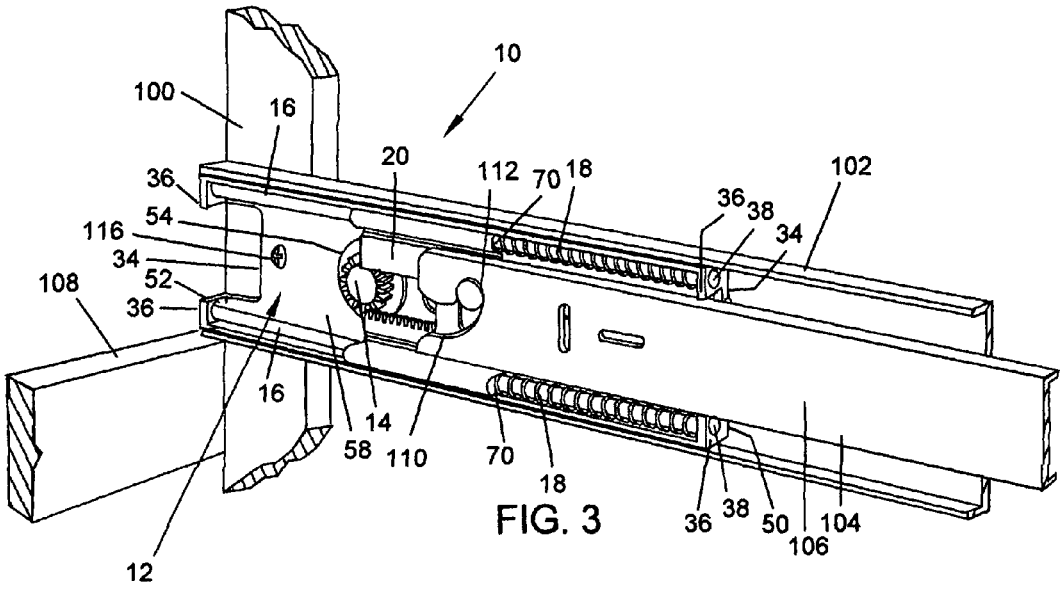
FIG. 3 illustrates a perspective view of an apparatus in a partial view of a drawer slide element and cabinet according to an embodiment of the invention.

Referring to FIGS. 1 through 3, a drawer slide closure apparatus 10 may have a generally rectangular support member 12 with a gear 14, slide pins 16 and coiled springs 18 positioned on the slide pins 16. There may be a slide member 20 slidably engaged with the slide pins 16 and the support member 12. A roller wheel 22 or disk having an axial shaft 24 with a first end 26 and second end 28 that may be positioned intermediate the support member 12 and the slide member 20.

The drawer slide closure apparatus 10 may be disposed in a drawer slide support 100 having two or more slide elements 102 through 106 mounted in a cabinet 108 as commonly understood for slide supports 100. The drawer slide closure apparatus 10 may be disposed in the drawer slide element 102 attached to the cabinet and may be attached by a fastener 116 inserted through a mounting aperture 15. The shaft 24 may be positioned for engagement with a slide element slot 110 as a drawer slide element 104 may be pushed into the cabinet 108 attached drawer slide element 102. The slide element slot 110 may move the shaft 24 from a locking slot 44 to allow springs 18 to urge the slide element 104 toward the rear of a cabinet 108. The gear 14 and rack 88 may engage to serve to slow or cushion the final drawer closure.

Figure 4:
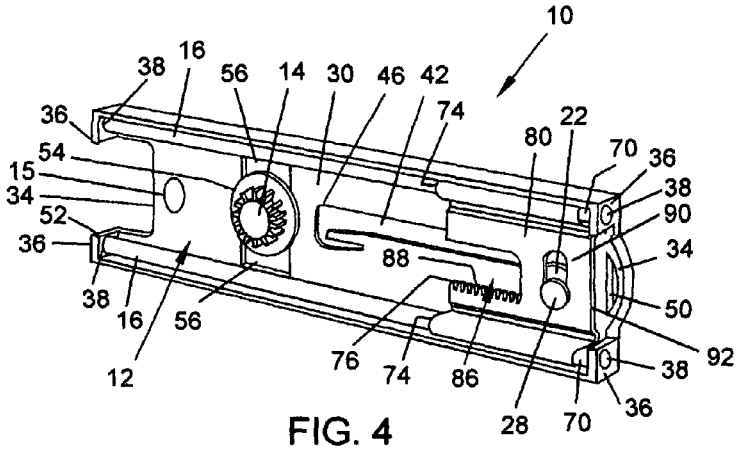
FIG. 4 illustrates a perspective view of an apparatus according to an embodiment of the invention.
Figure 5:
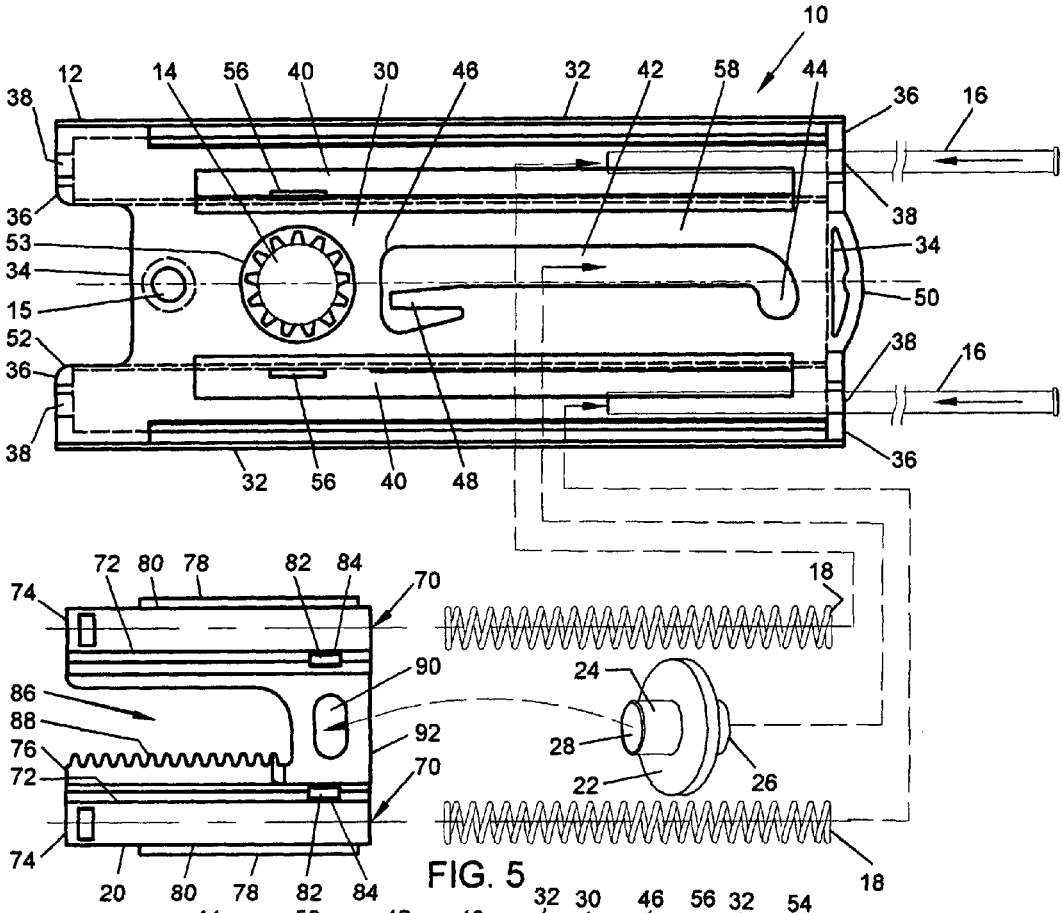
FIG. 5 illustrates an exploded elevation view of an apparatus according to an embodiment of the invention.
Figure 6:
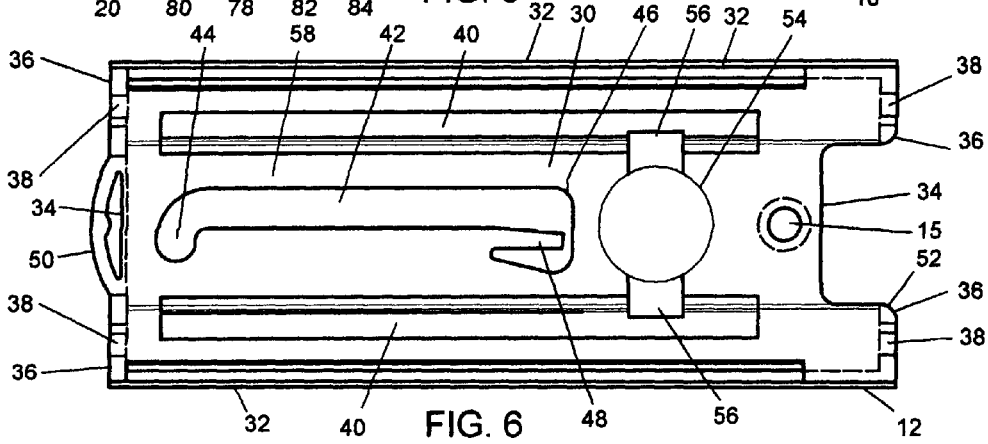
FIG. 6 illustrates a bottom view of a support member according to an embodiment of the invention.
Figure 7:
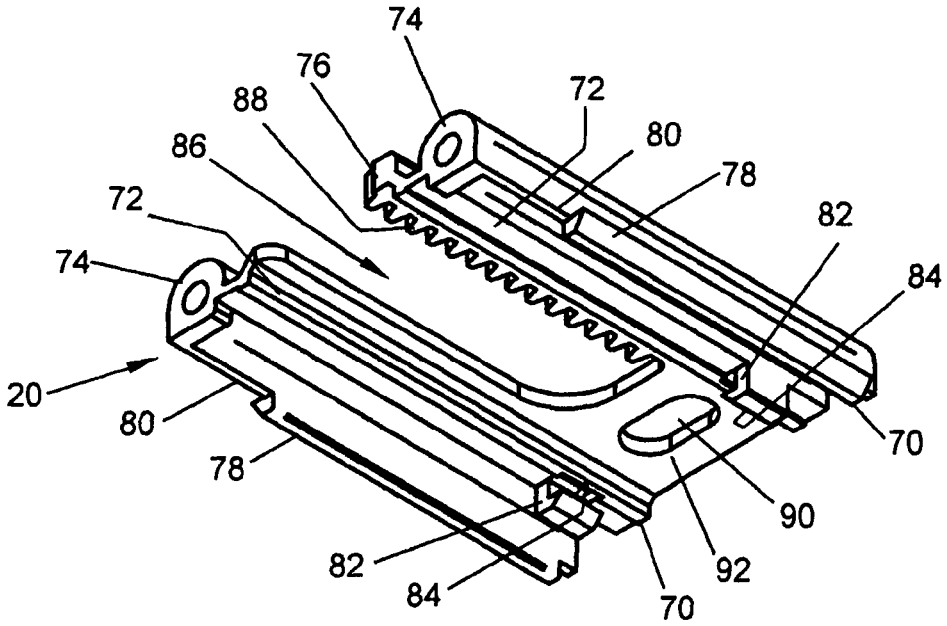
FIG. 7 illustrates a perspective bottom view of a slide member according to an embodiment of the invention.

Referring to FIGS. 4 through 6, the support member 12 may have a base 30, that is generally planar with longitudinal side walls 32 and generally open ends 34 having slide pin flanges 36 having pin apertures 38. There may be two spaced apart and parallel slide slots 40 formed in the base 30 for slidable engagement with the slide member 20. A roller slot 42 may be formed in the base 30 intermediate the gear 14 and an engagement end 50 and may be generally parallel to side walls 32.

There may be a gear recess 53 in the base 30 for insertion of the gear damper 54 attachment to gear mount 56 to position the gear 14.

Referring to FIGS. 4, 5, 7 and 8, the slide member 20 may have a generally rectangular shape with slide pin channels 70 at opposed sides 72 spaced apart to be disposed on slide pins 16. The slide rings 74 may be positioned at a rack end 76 of slide pin channels 70 to slidably engage the slide pins 16. A slide support flange 78 may be attached at an outer edge 80 of slide pin channels 70 positioned for slidably engagement of an edge with slide slots 40. There may also be slide tabs 82 at an inner edge 84 of slide pin channels 70 to slidably engage an edge of slide slots 40.

The slide member 20 may have a rack slot 86 with a rack 88 positioned for engagement with the gear 14 when the slide member 20 is slidably engaged with the support member 12. There may be a roller slot 90 adjacent a slot end 92 of the slide member 20.

Referring to FIGS. 1 through 5, in operation the closure apparatus 10 may have slide member 20 positioned at the engagement end 50 of support member 12 with shaft 24 positioned in lock slot 44. When slide element 104 may be slid rearwardly or toward a back of a cabinet 108 the slide element slot 110 at an open end 114 may receive the shaft 24 at second end 28 and as the slide element 104 moves rearwardly the slide element slot 110 may move the shaft 24 out of lock slot 44 and into the end catch 112 of the slide element slot 110. The movement of shaft 24 out of lock slot 44 may allow compressed springs 18 to urge the slide element 104 rearwardly. The rack 88 may engage the gear 14 to slow or buffer the drawer closure to reduce slamming of the drawer. When a drawer may be pulled to open it the shaft 24 and thereby the slide member 20 may be pulled toward the engagement end 50 thereby disengaging the rack 88 and gear 14 and compressing springs 18. The shaft 24 may be moved into the lock slot 44 to retain the slide member 20 adjacent the engagement end 50 as the drawer and slide element 104 may be pulled outwardly relative to the cabinet 108.

Referring to FIGS. 10 through 13, the drawer slide closure apparatus 10 may have the gear 14 positioned at the opposite end of the roller slot 42 as compared to that illustrated in FIGS. 1 and 5. The gear 14 and gear damper 54 may be disposed intermediate the roller slot 42 lock slot 44 and the engagement end 50. The gear 14 may be rotatably attached in the gear damper 54 as in the FIGS. 1 and 5 illustrations, but the gear damper 54 may have a lock pin 62 protruding outwardly opposite the gear 14.

The base 30 of the support member 12 may have a cavity 64 formed in the bottom surface 59. The gear damper 54 may be disposed with the gear 14 adjacent the top surface 58, with the lock pin 62 inserted through an elongated aperture 68 in the base 30, and with a lock gear 60 attached to the lock pin 62. This may position the lock gear 60 in the cavity 64.

There may be one or more lock teeth 66 formed in the circumferential wall 65 of the cavity 64 adjacent the roller slot 42. The lock teeth 65 may be positioned to engage the lock gear 60 teeth when the gear damper 54 may be urged toward the roller slot 42. When the lock gear 60 may be engaged with the lock teeth 66 the gear damper 54 may dampen the rotation of the gear 14. When the lock gear 60 may not be urged or pushed toward the roller slot 42, the gear damper 54, gear 14 and lock gear 60 may freely rotate as the lock pin 62 may move in the elongated aperture 68 toward the engagement end 50.

Figure 8:
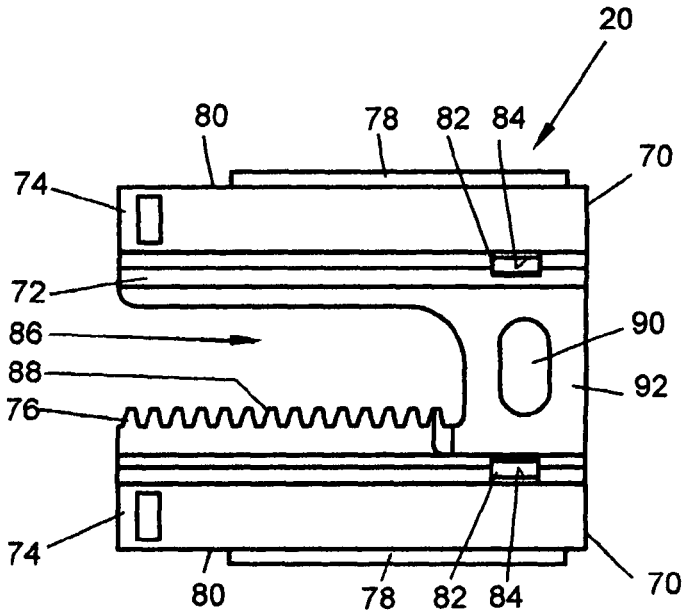
FIG. 8 illustrates a bottom view of a slide member according to an embodiment of the invention.
Figure 9:
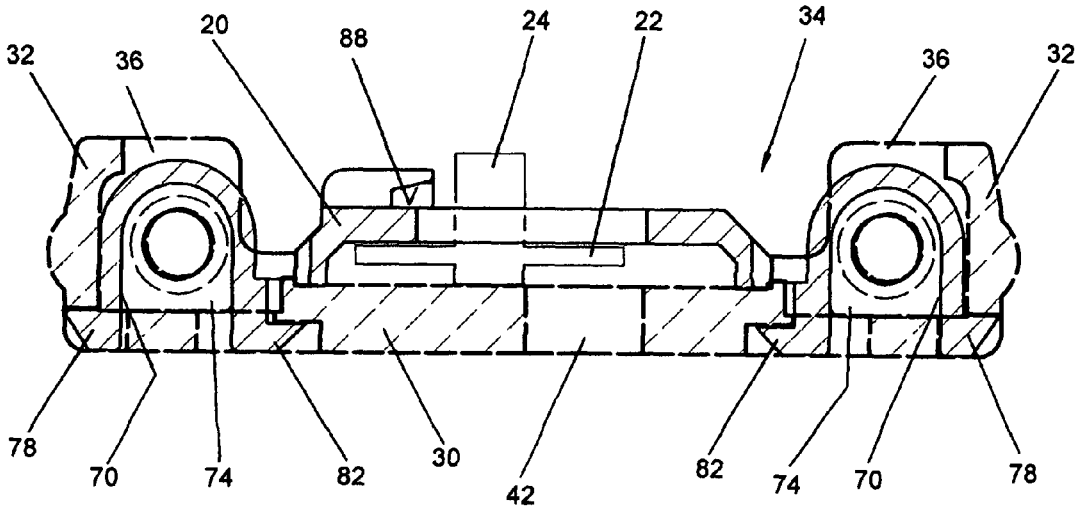
FIG. 9 illustrates an end cross sectional view of the apparatus according to an embodiment of the invention.
Figure 10:
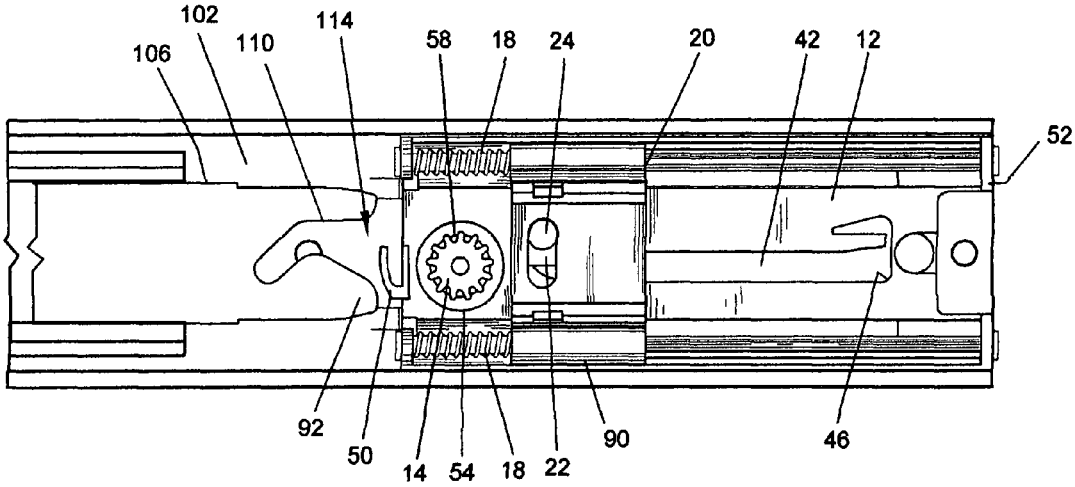
FIG. 10 illustrates a side view of an apparatus in a partial view of a drawer slide element according to an embodiment of the invention.
Figure 11:
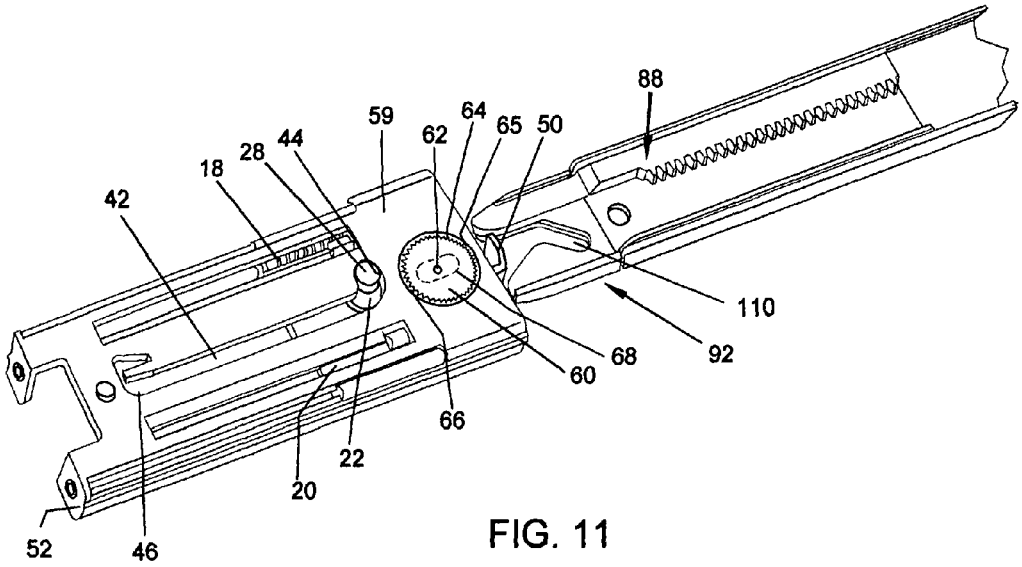
FIG. 11 illustrates a perspective view of an apparatus in a partial view of a drawer slide element according to an embodiment of the invention.
Figure 12:
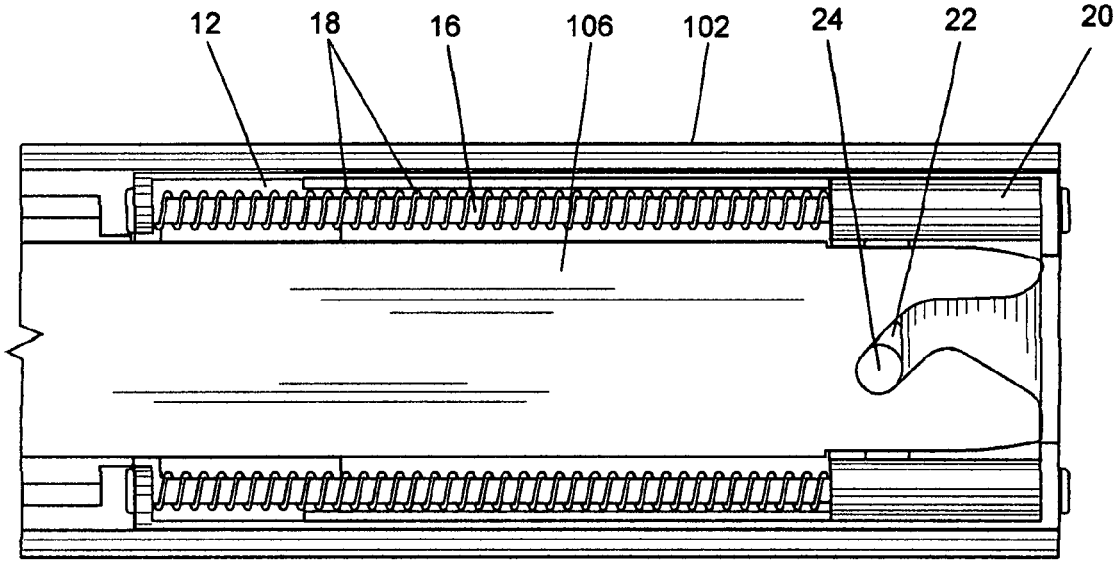
FIG. 12 illustrates a side view of an apparatus in a partial view of a drawer slide element according to an embodiment of the invention.
Figure 13:
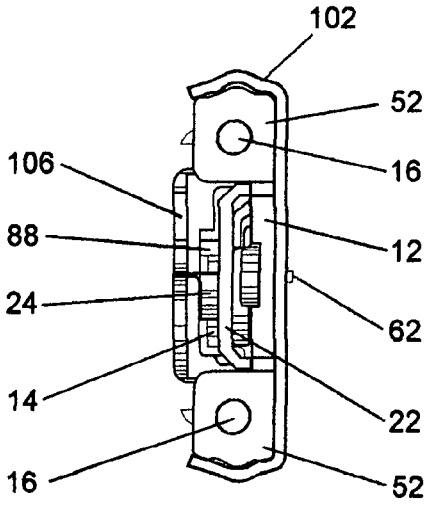
FIG. 13 illustrates an end view of an apparatus in a drawer slide element according to an embodiment of the invention.

The rack 88 may be disposed in the drawer slide element 106, as illustrated in FIG. 11, rather than in the slide member 20, as illustrated in FIGS. 1 and 8. The rack 88 may be positioned in the second drawer slide element 106 adjacent to the slot end 92 for engagement of the gear 14 when the slot end 92 may be pushed into the support member 12.

In operation the second drawer slide element 106 may be pushed into the support member 12 as a drawer may be closed. The slide element slot 110 may engage the shaft second end 28 thereby moving the shaft 24 out of the locking slot 44 to allow the springs 18 to aid in closing a drawer. The rack 88 may engage the gear 14 urging the gear damper 54 and lock gear 60 toward the roller slot 42 thereby engaging the lock gear 60 with the lock teeth 66. The gear damper 54 and gear 14 may act to dampen a rapid closing of a drawer.

When a drawer may be pulled to be opened, the gear damper 54 may be urged toward the engagement end 50 of the support member 12. The gear 14 may be allowed to rotate freely to minimize any damping effect on the movement of the drawer slide element 106. The withdrawal of the drawer slide element 106 from the support element 12 may pull the slide member 20 against the force of the coiled springs 18 until the shaft 24 is positioned in the lock slot 44 at which location the slide element slot 110 may disengage from the shaft 24 to allow further opening of a drawer.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus to assist in a drawer slide closure comprising:

a support member of generally rectangular form disposed in a first drawer slide element;

a slide member slidably disposed on a pair of slide pins that are attached at each end to a slide pin flange at a back end and an engagement end of said support member;

a spring disposed on each of said slide pins intermediate said engagement end and said slide member;

a shaft disposed at a first end in a roller slot formed longitudinally in a base of said support member and said roller slot having a lock slot;

a second end of said shaft disposed in a slide roller slot formed laterally in said slide member;

a shaft retainer disposed between said support member and said slide member;

a second drawer slide element having a slide element slot disposed to receive a portion of said second end of said shaft;

a gear rotatably attached in a gear damper that is attached to said base on a top surface intermediate a closed end of said roller slot and said back end; and a rack slot having a rack formed in said slide member wherein said rack slot having an open end disposed to receive said gear.

2. The apparatus as in claim 1 wherein said shaft retainer is a disk attached orthogonal to said shaft.

3. The apparatus as in claim 1 wherein said support member having longitudinal side walls attached to said base and to said slide pin flanges.

4. The apparatus as in claim 1 wherein said slide pin flanges having a pin aperture therein for insertion of said slide pins.

5. An apparatus to assist in a drawer slide closure comprising:

a support member of generally rectangular form disposed in a first drawer slide element;

a slide member slidably disposed on a pair of slide pins that are attached at each end to a slide pin flange at a back end and an engagement end of said support member;

a spring disposed on each of said slide pins intermediate said engagement end and said slide member;

a shaft disposed at a first end in a roller slot formed longitudinally in a base of said support member and said roller slot having a lock slot;

a second end of said shaft disposed in a slide roller slot formed laterally in said slide member;

a shaft retainer disposed between said support member and said slide member;

a second drawer slide element having a slide element slot disposed to receive a portion of said second end of said shaft;

a gear rotatably attached in a gear damper that has a lock gear attached by lock pin opposite said gear;

said lock pin is inserted through said base of said support member having an elongated aperture therein disposed intermediate said lock slot of said roller slot and said engagement end;

said gear damper disposed on a top surface of said support member and said lock gear disposed in a bottom surface in a cavity therein;

a lock tooth is formed in a circumferential wall of said cavity adjacent said roller slot; and a rack is disposed in said second drawer slide element wherein said rack is disposed adjacent a slot end of said second drawer slide element for engagement of said gear.

6. An apparatus to assist in a drawer slide closure comprising:

a support member of generally rectangular form disposed in a first drawer slide element;

a slide member slidably disposed on a pair of slide pins that are attached at each end to a slide pin flange at a back end and an engagement end of said support member;

a spring disposed on each of said slide pins intermediate said engagement end and said slide member;

a shaft disposed at a first end in a roller slot formed longitudinally in a base of said support member and said roller slot having a lock slot;

a second end of said shaft disposed in a slide roller slot formed laterally in said slide member;

a shaft retainer disposed between said support member and said slide member;

a second drawer slide element having a slide element slot disposed to receive a portion of said second end of said shaft;

said slide member having a slide pin channel attached at each opposed side approximately parallel to said slide roller slot;

a slide ring attached in each of said slide pin channels adjacent a rack end;

a slide support flange at an outer edge of each of said slide pin channels; and each of said slide support flanges slidably disposed in said base having a pair of slide slots formed longitudinally therein.

7. The apparatus as in claim 6 wherein a slide tab is attached at an inner edge of each of said slide pin channels disposed for slidably engagement with said slide slots at a side opposite said slide support flange.

* * * * *